United States Patent [19]

Weigel

[11] Patent Number: 4,841,874

[45] Date of Patent: Jun. 27, 1989

[54] PNEUMATIC-SPRING BOGIE

[75] Inventor: Rudolf Weigel, Markt Erlbach, Fed. Rep. of Germany

[73] Assignee: Man Guttehoffnungshütte GmbH, Oberhausen, Fed. Rep. of Germany

[21] Appl. No.: 145,893

[22] Filed: Jan. 20, 1988

[30] Foreign Application Priority Data

Jan. 20, 1987 [DE] Fed. Rep. of Germany ..... 3701424

[51] Int. Cl.[4] ..... B61F 3/08

[52] U.S. Cl. ..... 105/199.4

[58] Field of Search ..... 105/199.4, 198.1, 198.2, 105/198.3, 198.4, 198.5, 200, 201, 202, 210, 193

[56] References Cited

U.S. PATENT DOCUMENTS

| | | | |
|---|---|---|---|
| 2,191,408 | 2/1940 | Maris | 105/210 |
| 2,704,518 | 3/1955 | Buzareinques | 105/199.4 |
| 3,257,969 | 6/1966 | Thomas | 105/199.4 |
| 3,469,537 | 9/1969 | Barber | 105/198.6 |
| 3,895,787 | 7/1975 | Niehus et al. | 105/198.1 |
| 3,961,584 | 6/1976 | Paton | 105/202 |
| 4,013,016 | 3/1977 | Willets | 105/198.6 |
| 4,357,879 | 11/1982 | Mohacsi et al. | 105/202 |
| 4,363,277 | 12/1982 | Martin et al. | 105/210 |
| 4,638,742 | 1/1987 | Potel et al. | 105/199.4 |
| 4,690,388 | 9/1987 | Harrison | 105/198.1 |

FOREIGN PATENT DOCUMENTS

| | | | |
|---|---|---|---|
| 2137123 | 6/1977 | Fed. Rep. of Germany . | |
| 1157798 | 7/1969 | United Kingdom | 105/198.6 |

*Primary Examiner*—Richard A. Bertsch

*Attorney, Agent, or Firm*—Becker & Becker, Inc.

[57] ABSTRACT

A pneumatic-spring bogie, particularly for high-speed rail vehicles. These vehicles need a drive device for the bogie, which transmits not only tensile and impact forces but also absorbs vibration, particularly in the longitudinal direction. To this end, first and second rubber buffers are provided that surround the bogie pin in the longitudinal and transverse directions respectively in order to drive the bogie. The free end of the bogie pin is pivotably connected by a damping member to the cross-member of the bogie frame. Advantageously, the pivot point of the bogie is placed in a region between the rubber buffers and the damping member. Secondary suspension is effected by a pneumatic-spring bellows that is disposed concentrically to the bogie pin. The drive device and secondary suspension considerably simplify construction since the longitudinal member of the bogie no longer has to be bent at right angles, and since there is also no need for either connecting rods for driving the bogie or longitudinal vibration absorbers at the sides.

10 Claims, 2 Drawing Sheets

PNEUMATIC-SPRING BOGIE

BACKGROUND OF THE INVENTION

The present invention relates to a pneumatic-spring or pneumatically cushioned bogie, particularly for high-speed rail vehicles, in which a wagon or car is mounted on a transverse member of a bogie frame via a pneumatic air bellows that is disposed concentrically relative to an axis of rotation of the pneumatic-spring bogie. The car is secured against rolling by a support that is in the form of a torsion bar which is mounted horizontally in longitudinal members of the bogie frame, transverse to the direction of travel, and is rotatable, with the ends of the torsion bar being fixedly secured to longitudinal members of the car via levers and vertical articulated columns or hinged supports.

It is known to mount cars on cradle-less bogies by providing, as a secondary spring system, a centrally mounted pneumatic-spring bellows that concentrically surrounds the axis of rotation of the bogie. Such a pneumatic-spring bellows is connected on one side to a floor of the car, and on the other side to the cross-member of the bogie frame. A support is used to prevent the car from rolling if only one centrally-disposed pneumatic-spring bellows is used. The support comprises a torsion bar which is rotatably mounted in longitudinal members in the transverse central plane of the bogie, with the free ends of the torsion bar having levers and vertical hinged supports that are connected to the longitudinal members of the car. Such a support system neither has a specific drive device for transmitting tensile and impact forces from the bogie to the car, nor is provided with a device for absorbing jerky vibrations and limiting longitudinal and transverse motion (DE-OS No. 21 37 123) Kreissig dated June 2, 1977.

It is also known to connect a pneumatic-spring bellows in series with an emergency spring, such as a rubber-metal composite spring, which has a central bore.

Starting from the aforementioned type of suspension system, it is an object of the present invention to provide a means of linking the bogie to the car that allows specific transmission of tensile and impact forces, absorbs jerky vibrations and greatly helps to simplify the overall construction of the bogie.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The bogie of the present invention is characterized primarily in that the car is connected via a bogie pin, a damping member, and drive device to the transverse member of the bogie frame, with the damping member connecting a free end of the bogie pin to the transverse member; the drive device comprises first and second rubber buffers, and first and second fixed abutments, which surround the bogie pin with clearances, while the bogie pin extends into a recess in the transverse member of the bogie frame. The first rubber buffers are spaced from the bogie pin, in the direction of travel, by a distance that is less than the distance by which the second rubber buffers are spaced from the bogie pin in the transverse direction.

The damping member absorbs jerky vibrations, and the rubber buffers drive the bogie. Fixed abutments are provided for receiving forces which exceed the normal forces during operation. The centrally mounted pneumatic-spring bellows avoids the need to bend the longitudinal member of the bogie frame at right angles, as is necessary in the case of lateral pneumatic-spring bellows. The inventive features therefore considerably simplify the construction of the entire bogie, the main result of which is a reduction in manufacturing costs.

Further specific features of the present invention will be described in detail subsequently.

DESCRIPTION OF PREFERRED EMBODIMENTS

Figure 1:
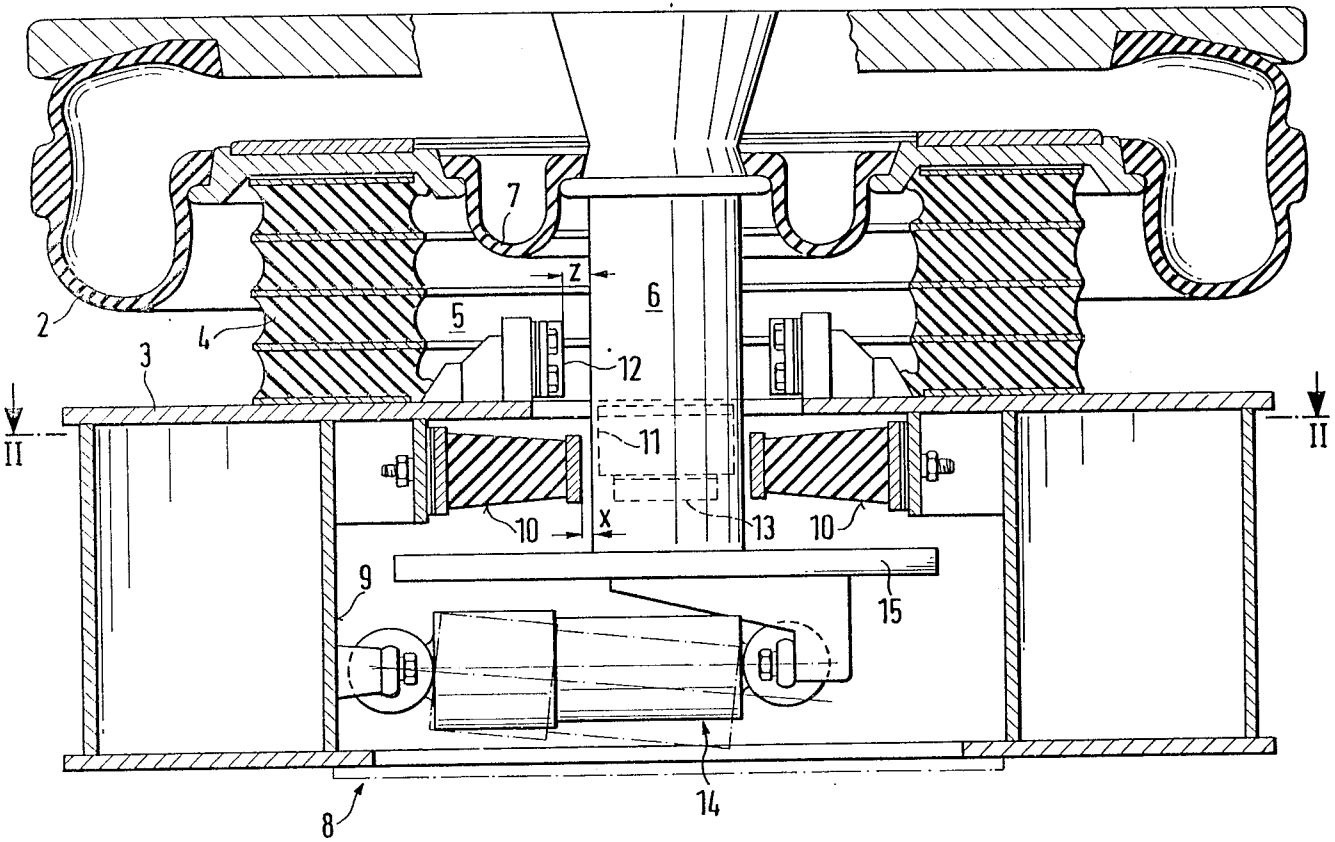
FIG. 1 is a longitudinal cross-sectional view through one exemplary embodiment of the invention bogie near a bogie pin.

Referring now to the drawings in detail, as shown in FIG. 1, a wagon or railroad car 1 is mounted via a pneumatic-spring bellows 2 on a cross-member 3 of a pneumatic-spring or pneumatically cushioned bogie. The bellows 2 bears on the transverse or cross-member 3 via an emergency spring 4 that is connected in series. The spring 4 is a rubber-metal composite spring and has a central bore 5 through which extends a pivot pin 6 that is permanently connected to the car 1. The seal between the spring 4 and the pin 6 can be a rubber sleeve or packing 7; alternatively, the seal can be a cover 8 that closes a recess 9 in the transverse member 3. The bogie is driven by a drive device that comprises first rubber buffers 10 and second rubber buffers 11. The buffers 10 surround the pin 6 in the direction of motion with a clearance x, which is usually 5 to 10 mm. The buffers 10 are disposed in the upper part of the transverse member 3 to keep the lever arm between their point of engagement and the car 1 to a minimum. In the event that tensile or impact forces exceed normal operating values, first fixed abutments 12 are provided on the upper side of the transverse member 3 in order to reduce or keep small the relationship of the lever arm to the car 1. The abutments 12 have a clearance z of about 18 mm to the bogie pin 6.

Figure 2:
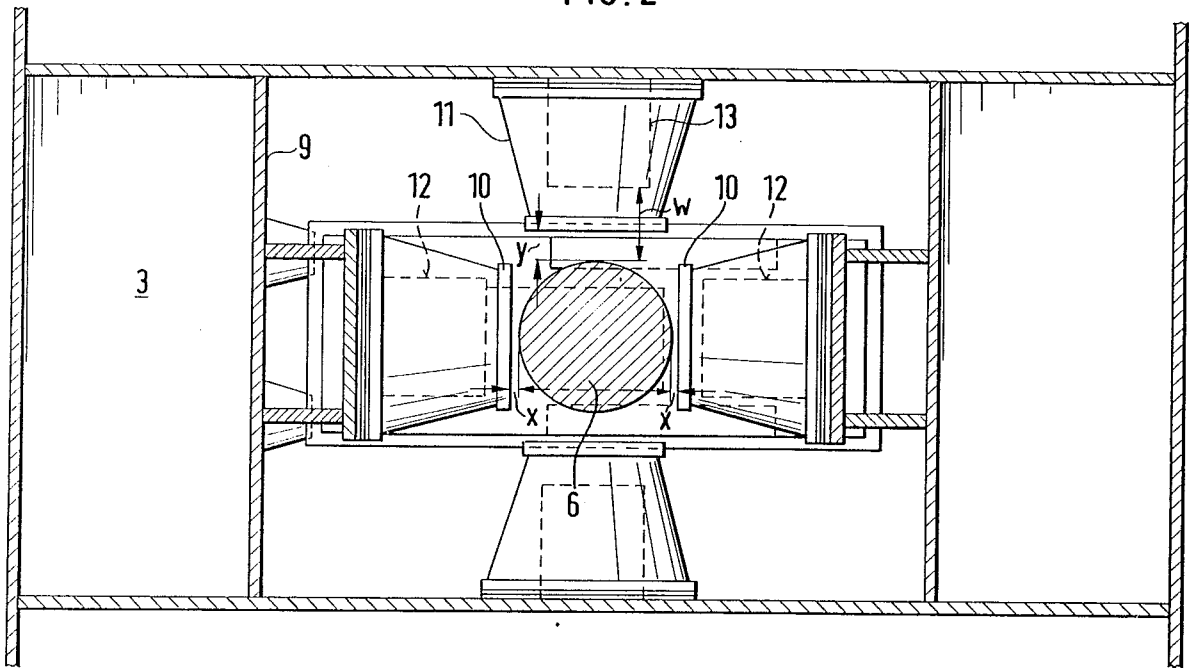
FIG. 2 is a cross-sectional view taken along line II—II in FIG. 1.

Transverse motion is limited by the second rubber buffers 11, which are disposed at about the level of the first rubber buffers 10 and surround the bogie pin 6 with a clearance y transverse to the direction of travel (FIG. 2). Second fixed abutments 13 are disposed directly below the buffers 11 in case the restoring forces of the latter are exhausted. The abutments 13 have a clearance w to the bogie pin 6 (FIG. 2).

In order to absorb jerk vibrations, a damping or antivibration member 14 is linked to the free end of the pin 6 and pivotably connects the car 1 to the cross-member 3. The damping member 14 can be a commercial vibration absorber that has incorporated therein a spring element. The member 14 absorbs longitudinal vibrations between the bogie and the car 1, with such vibrations being experienced as unpleasant jerks. Since the forces that are to be absorbed by the damping element 14 at the end of the bogie pin 6 are small compared with the forces in the rubber buffers 10, i.e. the drive device, the bogie pin is also relieved from load and its cross-sectional area can be reduced.

The member 14 is linked to the pin 6 by a plate 15, which gives protection against liftingoff.

A special advantage of the central pneumatic-spring bellows 2 and the drive device, the pin 6 of which extends through the recess 9 in the transverse member 3, consists in the longitudinal members (not shown) of the bogie, which are continuous and do not need to be bent at right angles in the middle, as in the case when two pneumatic spring bellows are disposed at the side.

This considerably simplifies construction and therefore reduces costs.

A special advantage of the bogie drive of the present invention is that, as a result of the nonbent longitudinal members, the transverse member 3 can be disposed higher and therefore the pitch point of the bogie can be placed at a height between the buffers 10, 11 and the antivibration member 14. This avoids stimulation of the pitching motion of the bogie, and a simple structural device can be used to avoid the dreaded superposition of the pitching frequency of the bogie on the bending frequencies of the car. The construction of the primary suspension system is also considerably simplified. This advantage applies particularly to travel on a bad track bed.

It should be noted that the illustrated drive device in conjunction with the damping member 14 is not restricted to a centrally positioned pneumatic-spring bellows. On the contrary, the secondary suspension can also comprise a number of pneumatic-spring bellows or coil springs, if necessary for other reasons, although this results in the previously-mentioned disadvantages as compared with a centrally positioned pneumatic-spring bellows.

As shown in the cross-sectional plan view of FIG. 2, the pin 6 is surrounded by the first rubber buffers 10 with a clearance x in the direction of travel for transmitting tensile and impact forces. After the spring travel of the buffers 10 has been exhausted, the first fixed abutments 12 come into action. Transverse motion is limited by the second rubber buffers 11 and the second fixed abutments 13. The transverse clearance between the bogie pin 6 and the second rubber buffers 11 is y and is about 20 mm. The second fixed abutments 13 have a clearance w. The entire drive device is disposed in a recess 9 in the transverse member 3.

The present invention is, of course, in no way restricted to the specific disclosure of the specification and drawings, but also encompasses any modifications within the scope of the appended claims.

What is claim is:

1. In a pneumatic-spring bogie, particularly for high-speed rail vehicles, in which a car is mounted on a transverse member of a bogie frame via a pneumatic air or spring bellows that is disposed concentrically about an axis of rotation of the pneumatic-spring bogie, with the car being secured against rolling by a support which is mounted horizontally in longitudinal members of the bogie frame, transverse to the direction of travel, and is rotatable, with the ends thereof being fixedly secured to the longitudinal members of the car via levers and vertical hinged supports, the improvement therewith wherein:

said car is further connected to said transverse member of said bogie frame via a bogie pin, a vibration damping member, and a drive device, with said bogie pin having two ends, one connected to said car and the other to said damping member, which is in turn connected to said transverse member, and with said drive device comprising first and second rubber buffers as well as first and second fixed abutments, with said rubber buffers and said fixed abutments being spaced from said bogie pin by given clearances; said transverse member being provided with a recess into which said bogie pin extends, said transverse member being disposed higher as a result of said longitudinal members and therefore a pitch point of the bogie can be placed at a height between said buffers and the vibration damping member to avoid stimulation of any pitching motion of the bogie and consequently to avoid dreaded superposition of pitching frequency of the bogie on bending frequencies of the car.

2. A bogie according to claim 1, in which said damping member is a vibration absorbing having incorporated therein a spring element in the tension and compression direction.

3. A bogie according to claim 2, in which said damping member is connected to said bogie pin via a plate that is dimensioned in such a way that it prevents lift-off.

4. A bogie according to claim 1, in which said pneumatic-spring bellows is connected in series with an emergency spring that is in the form of a rubber-metal composite spring which is connected to said transverse member and has a bore through which said bogie pin extends concentrically, with said bore being sealed from the outside by sealing means.

5. A bogie according to claim 4, in which said sealing means is in the form of a rubber packing that is connected on the one hand to a top rim of said emergency spring, and on the other hand to said bogie pin.

6. A bogie according to claim 4, in which said sealing means is in the form of a cover that hermetically closes off said recess of said transverse member.

7. A bogie according to claim 1, in which said first rubber buffers are disposed on opposite sides of said bogie pin, in the direction of travel, and are spaced therefrom by a first clearance; and in which said second rubber buffers are disposed on opposite sides of said bogie pin, in the transverse direction, and are spaced therefrom by a second clearance that is greater than said first clearance.

8. A bogie according to claim 1, in which said first fixed abutments are disposed in the vicinity of an upper portion of said transverse member and are spaced from said bogie pin in the longitudinal direction by a third clearance; and in which said second fixed abutments are disposed at about the level of said first rubber buffers and are spaced from said bogie pin in the transverse direction by a fourth clearance.

9. A bogie according to claim 1, in which said longitudinal members of said bogie frame are continuous, i.e., are not bent at right angles.

10. A bogie according to claim 1, in which the level of the pitch point of said bogie is disposed in a region between said rubber buffers and said damping member.

* * * * *